United States Patent [19]

Hoffman

[11] Patent Number: 4,923,418

[45] Date of Patent: May 8, 1990

[54] EXERCISE GLOVE

[76] Inventor: Ned Hoffman, 414 S. 44th St. (A-1), Philadelphia, Pa. 19104

[21] Appl. No.: 289,191

[22] Filed: Dec. 23, 1988

[51] Int. Cl.[5] ..... A63B 31/04

[52] U.S. Cl. ..... 441/57; 272/67; 272/71; 272/119; 441/58

[58] Field of Search ..... 441/56–58; 272/67, 71, 119

[56] References Cited

U.S. PATENT DOCUMENTS

| | | | |
|---|---|---|---|
| 1,329,073 | 1/1920 | Czicziriga | 441/57 |
| 2,169,939 | 8/1939 | Anderson | 441/57 |
| 3,231,910 | 2/1966 | Tegland | 441/57 |
| 3,257,673 | 6/1966 | Rademacher | 9/308 |
| 4,058,863 | 11/1977 | Ferdico | 441/57 |
| 4,195,365 | 4/1980 | Eyman | 441/57 |
| 4,326,706 | 4/1982 | Guthrie et al. | 272/119 |
| 4,548,588 | 10/1985 | Kosuge | 441/57 |
| 4,669,991 | 6/1987 | Southworth | 441/57 |
| 4,746,313 | 5/1988 | Bray et al. | 441/57 |
| 4,755,158 | 7/1988 | Wise | 441/57 |

*Primary Examiner*—Sherman D. Basinger

*Attorney, Agent, or Firm*—Townsend & Townsend

[57] ABSTRACT

Exercise gloves to enhance the results of aerobic, swimming or running exercises. The glove is comprised of a mitt having finger stalls covering the entire hand. Webbing is provided extending from the mitt to the proximal end of the distal phalanges area of the finger stalls. Additionally, insert pockets adapted to receive weights are mounted to the forehand portion of the mitt. Weights in the inserts increase exercise efficiency and produce enhanced exercise results. Similarly, an insert pocket is provided on the palm portion of the mitt adapted to receive an additional weight which also provides the exerciser with a convenient gripping surface. A band mounted to the insert pocket on the forehand portion of the glove is provided for securing the weights to the exerciser's hand through the mitt thereby preventing the weights from shifting during exercise activity.

9 Claims, 2 Drawing Sheets

EXERCISE GLOVE

FIELD OF THE INVENTION

This invention relates to exercise equipment. More specifically, this invention relates to an exercise glove to enhance the results of physical motion during exercise.

BACKGROUND OF THE INVENTION

It has been known in the exercising art to use exercise gloves for various physical activities. These gloves have been used in many sporting activities including for example, swimming, aerobics and sky diving. Various designs of exercise gloves have been used to facilitate more efficient exercise and better utilization of body movement during the exercising process.

Exercise gloves which have been used to enhance swimming activities are also present in the prior art. Examples of such devices may be found, for example, in U.S. Pat. No. 4,755,158, Wise. The Wise patent discloses a mitt made of latex for improving positive water displacement when a swimmer paddles in the water. The gloves have webbing extending between adjacent digit pockets on the gloves. Similar types of gloves are disclosed in U.S. Pat. No. 4,195,365, Eyman. Eyman also discloses the use of webbed gloves for aquatic activity and sky diving.

The Eyman patent further discloses finger stalls joined together with a web. Additionally U.S. Pat. No. 2,169,939, Anderson discloses a swimming glove having accordion-like, pleated webs between the finger portions of the glove so that when the fingers are together, the webs will remain folded neatly between the fingers and thumb without interfering with the grasping function of the hand. As with the gloves disclosed in the Eyman and Wise patents, the gloves disclosed in the Anderson patent are generally useful for increasing swimming agility and speed due to the action of the webbed portion of the glove between the finger stalls in the water.

However, the exercise gloves disclosed in the aforementioned patents fail to satisfy a long felt need in the art for exercise gloves which can be used in aquatic or other sports and that are useful for producing maximal results from physical exercise. The gloves disclosed in the previous patents secure the webbing to the finger stalls at the distal end of the distal phalanges of the fingers. This creates a severe disadvantage since the exercise forces acting on the webbing causes inertial forces to be concentrated at the weakest point on fingers thereby causing excess muscle stress to develop in the non-primary muscle groups found in the fingers and hands. The finger and outer hand muscle groups are considered herein as non-primary muscle groups since exercising gloves provided in accordance with this invention are not intended to primarily benefit these muscle groups. Unnecessary stress of this nature reduces exercise results for the primary muscle groups. Exercise gloves provided in accordance with this invention are intended to benefit primary muscle groups such as, for example, back muscles, shoulder muscles and upper and lower arm muscles. The inventor of the subject matter herein disclosed has discovered that securing the webbing between the proximal end of the distal phalanges of the fingers and the palm of the hand eliminates undue stress induced in non-primary muscle groups.

Decreasing the stress induced in non-primary muscle groups over even a short distance while exercising creates a significant increase in the exercise efficiency of the primary muscle groups under exertion. Additionally, fatigue induced in the non-primary muscle groups due to the misplacement of the webbing which otherwise decreases the amount of time that a user of the glove can engage in exercise is eliminated with exercise gloves provided in accordance with this invention, thereby increasing the potential benefits that a person can obtain in the primary muscle groups from longer duration exercising. The inventor has discovered that the aforementioned unexpected results are achieved when the webbing is placed between the proximal end of the distal phalanges and the palm of the hand.

Other prior art devices have been devised which aid swimmers in performing swimming exercises. Examples of such devices are disclosed in U.S. Pat. No. 4,746,313, Bray et al. The Bray patent teaches a swimming aid with truncated finger stalls adapted to generally conform to the shape of an outspread hand. Webbing is provided between the finger stalls to aid the swimmer in achieving greater propulsion in the water. The devices disclosed in Bray teach truncating the finger stalls at the distal end of the middle phalanges which leaves the distal phalanges exposed to the outside environment. Furthermore, the gloves disclosed in Bray only generally conform to the shape of an outspread hand and do not allow a swimmer to manipulate his fingers within the glove thereby preventing the glove from attaining comfortable flexed shapes.

In order to maintain the webbing position on the gloves, the devices disclosed in Bray rely on tightly binding the glove material to the fingers thereby placing extreme stress directly on the finger lengths. It is known by those with skill in the art that when muscles are being used in exercise, blood flow must be continuously provided to the muscles in order for the muscles to avoid undue lactic acid buildup. Thus, the finger muscles must not be tightly squeezed by the glove since blood flow to the finger muscles will greatly decrease and muscle fatigue will be accelerated.

The devices disclosed in Bray fail to solve a long felt need in the art for exercise gloves which provide exercise appliances that promote continuous blood flow to the fingers thereby minimizing muscle fatigue during exercise. Similar prior art devices to those disclosed in Bray may be found in U.S. Pat. No. 3,231,910, Tegland; U.S. Pat. No. 4,669,991, Southworth; and U.S. Pat. No. 4,058,863, Ferdico. None of the exercise gloves taught in the above mentioned patents fulfill a long felt need in the art for efficient exercise appliances to aid an exerciser in maximizing the results of his exercise routine or workout.

Other exercise appliances are disclosed in the prior art which aid exercisers in performing a particular exercise. U.S. Pat. No. 4,548,588, Kosuge, discloses one such appliance for swimming. The device in Kosuge is not a glove per se but rather, is comprised of a plurality of tubular members joined together by web like members extending between each adjacent tubular member. The tubular members are intended to fit over human fingers and aid a swimmer in the water with induced propulsion power. The devices disclosed in Kosuge do not fulfill a long felt need in the art for gloves which aid exercisers in swimming since they are not securable to the hand and thus may easily fall off during exercise procedures. Additionally, the exercise aids disclosed in Kosuge tend to enhance fatigue by stressing the muscles along the fingers and wrists since they force the user to tense his hand to hold the appliance in place.

U.S. Pat. No. 3,257,673, Rademacher, discloses similar exercise appliances to those disclosed in Kosuge. The devices disclosed in Rademacher suffer similar problems as those devices disclosed in Kosuge since they are not gloves but are merely tubular members fastened together with webbing. The swimming appliances disclosed in Rademacher teach the elimination of a facing piece over the palm and the elimination of a rear backing which would aid in securing the glove to the hand. Instead, a wrist band is used to retain the device in its preferred position on the hand. This arrangement is inadequate to consistently secure the appliance to the hand. Thus the devices disclosed in Rademacher do not fulfill a long felt need in the art for exercise appliances which efficiently help an exerciser maximize the results of his exercise regimen.

None of the prior art devices discussed above teach or disclose exercise gloves which are able to aid an exerciser in maximizing his or her exercise regimen. Rather, the prior art merely discloses devices which increase resistance with the use of webbing across finger stalls. This arrangement allows a swimmer to swim faster but cannot enhance the effects of any exercising routine. The devices disclosed in the prior art also do not fulfill a long felt need in the art recognized by the inventor for exercise appliances that enhance exercise effectiveness in any exercise routine. In contrast, exercise appliances provided in accordance with this invention fulfill a long felt need in the art for devices that increase the effects of any exercise that requires shoulder, arm or hand motion as an integral part of the exercise routine.

SUMMARY OF THE INVENTION

Accordingly, it is an object to the present invention to provide an exercise appliance which enhances an individual's exercise regimen and fits over a human hand.

It is a further object of the present invention to provide an exercise glove for use in swimming exercises.

It is another object of the present invention to provide an exercise glove for use in aerobic activities.

It is still another object of the present invention to provide an exercise glove for use in jogging or running activities.

It is yet another object of the present invention to provide an exercise glove having webbing between the finger stalls of the glove.

It is yet another object of the present invention to provide an exercise glove wherein the webbing is located along the finger stalls between the end of the mitt to the proximal end of the distal phalanges.

It is yet another object of the present invention to provide an exercise glove which enhances the results of an individual's exercise activities.

It is yet another object of the present invention to provide an exercise glove having pockets to receive weights integrally located along the backhand portion of the glove.

It is yet another object of the present invention to provide an exercise glove having a pocket for a gripping weight in the palm portion of the glove.

It is yet another object of the present invention to provide an exercise glove with a pocket located in the wrist of the glove in which an exerciser may store incidental items.

It is yet another object of the present invention to provide an exercise glove having a strap integrally attached to the glove which secures the weights to the user's hand in a fixed position through the palm and the back of the glove.

These and other novel objects, advantages and features of the present invention are fully realized by an exercise glove adapted to receive a human hand comprising a mitt having finger and thumb stalls with proximal and distal ends. In a preferred embodiment, webbing secured to the finger and thumb stalls about the proximal ends of the distal phalanges of the finger and thumb stalls are provided.

In further preferred embodiments, means for receiving at least one weight secured to the mitt's forehand surface is provided. Additionally, means for securing the weights against an exerciser's hand through the mitt is also provided. In still further preferred embodiments of exercise gloves provided in accordance with this invention, a gripping weight is secured to the palm portion of the glove so that, for example, when a runner jogs with the gloves, he can grip the weights thereby providing him ease of running comfort and enhanced exercise results due to the weights in the backhand portion and palm portions of the glove.

Exercise gloves for enhancing the results of exercising regimens are provided in accordance with this invention. The exercise gloves provided in accordance with this invention provide increased exercise efficiency and enhanced exercise results for a variety of exercising techniques. It is envisioned that any aerobic, swimming or jogging exercises will be greatly enhanced by preferred embodiments of exercise gloves provided in accordance with this invention.

Thus in preferred embodiments, an exercise glove comprising a mitt having finger and thumb stalls adapted to receive a human hand are provided. Finger and thumb stalls are generally known by those with skill in the art as extensions of a glove wherein a finger or thumb resides when the glove is on the hand. In still further preferred embodiments, webbing secured to the finger and thumb stalls of the glove is provided. Preferably, the webbing is secured to the proximal end of the distal phalanges of the finger and thumb stalls. Thus, the webbing is placed below the tips of the fingers and thumb on the gloves and is continuous to the palm of the glove.

In still further preferred embodiments, at least one insert pocket adapted to receive a weight is secured to the mitt's forehand surface. The weights will provide enhanced exercise results in either swimming, aerobic or running activities. In further preferred embodiments, means for securing the weight residing in the insert pocket against the hand through the mitt is provided such that when the glove is in use, the weights are securely fastened against the hand and do not slip or move against the hand when an individual is exercising.

Figure 1:
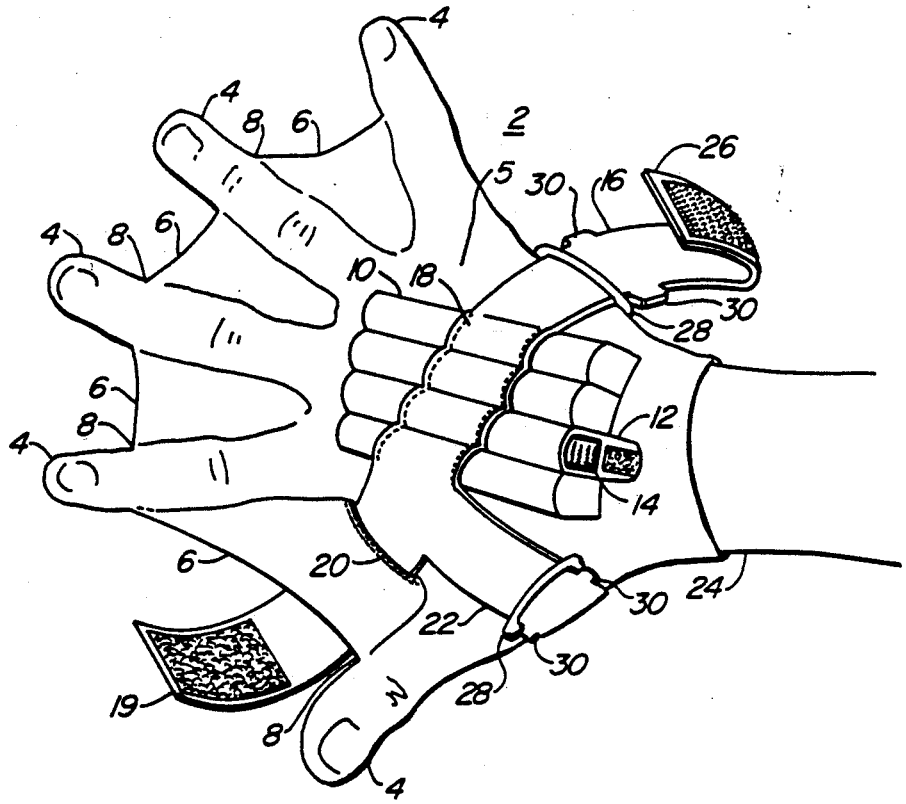
FIG. 1 is an isometric view of a preferred embodiment of exercise gloves provided in accordance with this invention, showing the backhand portion of the glove.

Referring now to the drawings wherein like numerals refer to like elements, FIG. 1 is an isometric view of a preferred embodiment of an exercise glove provided in accordance with this invention, showing a forehand view of the glove. The exercise glove is shown generally at 2 with a user's hand disposed within the glove. The glove covers the entire hand including the entirety of the fingers. In order to achieve maximal exercise benefit with least stress on the non-primary muscle groups, glove 2 covers the distal phalanges of the fingers and thumb, shown generally at 4. The mitt portion of the glove is shown generally at 5.

When the glove is used for swimming, webbing 6 is particularly useful. In order to achieve maximal exercise efficiency with the webbing and the least stress on the fingers and wrist, the webbing is fixed at the proximal end of the distal phalanges of the fingers and thumb, shown generally at 8. Thus, exercise gloves provided in accordance with this invention optimally enhance exercise results by providing maximum aid in exercise motion with webbing 6 but minimal undue stress on the non-primary muscle groups from the webbing due to the placement of the webbing on the fingers. Additionally, in preferred embodiments the exercise glove could be constructed out of an elastomeric material such as, for example, Spandex, thereby providing the ability for the glove to be used with exercisers having different sized hands. It is further envisioned that, in preferred embodiments, the glove would be permeable to vapor but not permeable to water. Thus, the glove could be coated with materials such as, for example, Goretex (trademark of W. L. Gore & Associates Inc.) so that the glove would be waterproof and yet breathable thereby allowing sweat developed during exercise to evaporate through the Goretex material.

One highly important feature of the present invention is the addition of weights to the glove which enhances exercise results on the primary muscle groups for any type of swimming, aerobic or jogging activities. Insert pockets 10 are mounted on the forehand portion of the mitt. Insert pockets 10 are adapted to receive weighted objects which will increase the weight of the hand in general. The weighted objects then aid in enhancing exercise activity as conventional weights would in any exercise setting. Insert pockets 10 can be opened 12 so that a weight 14 can be inserted and removed as the exerciser sees fit.

Depending upon the user's exercise abilities, a number of weights 14 could be inserted in insert pockets 10 to achieve maximal exercise efficiency. In any event, insert pockets 10 are constructed as an integral portion of glove 2 and a variety of weighted objects could be placed in the inserts to achieve maximum exercise efficiency on the primary muscle groups. The use of weights 14 with glove 2 greatly enhances a work-out for a swimmer, runner or aerobic exerciser since the primary muscle groups under consideration during the exercise regimen are placed under greater exercise stress during a work-out with the exercise glove than they normally would be during a work-out without the glove.

While insert pockets 10 are integrally mounted on exercise glove 2, in preferred embodiments a band 16 is provided which is also integrally mounted at 18 to glove 2 through insert pockets 10. Band 16 secures weights 14 and inserts 10 through glove 2 to the user's hand such that weights 14 and insert pockets 10 do not slip on the hand through glove 2 while the exerciser's hand is in motion during exercise. Band 16 can generally be wrapped around the entire palm and forehand portion of mitt 5 across insert pockets 10 when insert pockets 10 are filled with weights 14. The first end 19 of band 16 is passed over insert pockets 10 through webbing 6 between the forefinger and thumb. The first end 19 of band 16 is passed through a slot 20 provided in webbing 6 between the forefinger and thumb stalls so that the band may be secured to the palm portion of glove 2.

Additionally, a second end 22 wraps around the thumb substantially adjacent to the wrist 24 and is secured to the first end 19 of band 16 on the palm side of mitt 5. The third end 26 of band 16 passes over insert pockets 10 and is wrapped to the palm side of the glove where it is secured. The second and third ends of band 16 are secured to the forehand side of mitt 5 through rings, shown generally at 28. Rings 28 prevent the second and third ends of band 16 from slipping back across the forehand portion of mitt 5 when the band is not secured to the palm. Thus, rings 28 ensure that band 16 is secured to mitt 5 at all times when the glove is in use or out of use so that band 16 is never lost or misplaced Band 16 cannot slip through rings 28 since rectangular tabs 30 are provided on the outside portion of band 16 along the ends which slip through rings 30 such that rectangular tabs 30 prevent the ends from slipping through rings 28.

Figure 2A:
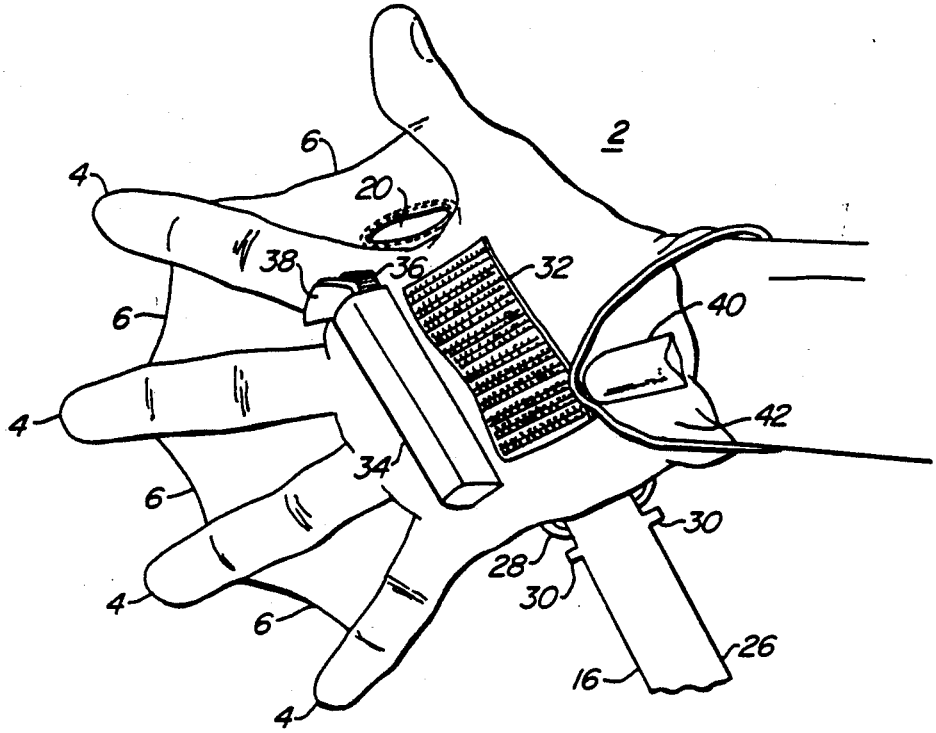
FIG. 2A is a view of a preferred embodiment of exercise gloves provided in accordance with this invention, showing the palm portion of the glove.

Referring now to FIG. 2A, the palm side portion of glove 2 is shown. Webbing 6 extends between the proximal end of the distal phalanges 4 of the finger and thumb stalls and mitt 5. The third end 26 of strap 16 is threaded through ring 28 and held in place by tabs 30. Band 16 can be secured to the palm of glove 2 across insert pockets 10 by a securing means, for example Velcro, shown at 32. The first end 19 of band 16 is placed through webbing 6 through slot 20.

In addition to insert pockets 10 and weights 14 on the backhand portion of mitt 5, an insert pocket 34 is provided, in preferred embodiments, on the palm side portion of mitt 5 in which an insertable weight 36 may be placed. Insertable weight 36 may be removed as flap 38 is opened to expose the inner portion of insert pocket 34. Weight 36 is termed a "gripping weight" and may be used by runners to aid in forming a fist when the runner is jogging. Thus, weight 36 installed in insert pocket 34, in addition to providing extra weight and increased exercise efficiency, provides a runner with a grip to hold during running. Weight 36 conveniently aids in providing comfortable and efficient exercise activity when a grip is desired by a runner, swimmer or aerobic exerciser.

In further preferred embodiments of exercise gloves provided in accordance with this invention, a small pocket 40 is provided in the inner lining 42 of glove 2. Pocket 40 thus rests directly against the skin of the wrist and on the inner liner 42 of glove 2. In preferred embodiments, pocket 40 is adapted to receive incidental items which an exerciser desires to carry on his or her person while he or she is exercising. Examples of such incidental items are keys, change or small items of jewelry. Therefore, pocket 40 provides a convenient means for an exerciser to carry incidental but necessary items while he or she is exercising with exercise glove 2.

Figure 2B:
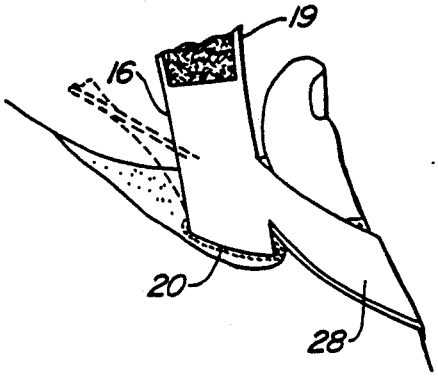
FIG. 2B is an illustration of a preferred embodiment of exercise gloves provided in accordance with this invention showing the position of a means for securing the weights to the glove around the forefinger and thumb stalls.

Referring to FIG. 2B, band 16 is shown wrapped around the thumb stall of glove 2. The first end 19 of band 16 is passed through slot 20 and outwardly extends so that it may be fastened to securing means 32. The second end 28 of band 16 is wrapped around the thumb and secured to the first end 19 thereby providing a firm connection for band 16 across insert pocket 10 and allowing the thumb free and easy motion during exercise.

There have thus been described certain preferred embodiments of exercise gloves provided in accordance with this invention. While preferred embodiments have been shown and described, modifications are within the true spirit and scope of the invention. The appended claims are intended to cover all such modifications.

What is claimed is:

1. An exercising glove comprising:

a mitt having a forehand portion and a palm portion;

a plurality of finger stalls integrally formed on the mitt;

webbing disposed between the finger stalls extending from a point on the mitt where the finger stalls begin to about a point corresponding to the location where a human finger's distal phalange begins when the glove is on a human hand;

a plurality of first insert pockets mounted to the forehand portion of the mitt for receiving a plurality of weights;

at least one second insert pocket mounted to the palm portion of the mitt for receiving a gripping weight;

strap means mounted across the plurality of first insert pockets and securable to the palm portion of the mitt;

a slot formed in the webbing between the forefinger stall and thumb stall through which the strap means is disposed;

a first ring secured to the mitt through which a first end of the strap is disposed;

a second ring secured to the mitt through which a second end of the strap is disposed;

tabs integrally formed on the strap which prevent the first and second ends of the strap from completely passing through the rings; and a pocket formed on the mitt adapted to receive small items.

2. A glove for enhancing the effect of exercise comprising:

a mitt having a forehand portion and a palm portion;

finger stalls integrally formed at a distal portion of the mitt;

at least one insert mounted to the mitt, the insert being adapted to receive a weight;

first means for securing the weight directly to a hand through the glove; and a ring mounted to the glove for securing the first means to the glove.

3. The glove recited in claim 2 wherein the first means further comprises a plurality of notches disposed on the first means for securing the first means to the glove.

4. The glove recited in claim 3 further comprising means mounted to the palm portion of the mitt for securing the first means to the palm portion of the mitt.

5. A glove for enhancing the effect of exercise comprising:

a mitt having a forehand portion and a palm portion;

finger stalls integrally formed on the distal portion of the mitt;

at least one insert mounted to the mitt, the insert being adapted to receive a weight;

first means for securing the weight directly to a hand through the glove; and webbing disposed between the finger stalls including a slot in the webbing between the forefinger and thumb finger stalls through which the first means is disposed.

6. A method of manufacturing an exercising glove comprising the steps of:

constructing an expandable mitt with a forehand portion and a palm portion having finger stalls with areas for human fingers;

webbing the mitt to a point below the distal phalange areas;

mounting at least one insert pocket on the distal portion of the mitt adapted to receive a weight; and mounting a strap across the insert pocket.

7. The method of claim 6 further comprising the step of providing means mounted to the palm portion of the mitt for securing the strap to the palm portion of the mitt;.

8. The method of claim 7 further comprising the step of mounting at least one ring on the forehand portion of the mitt through which the strap can be placed.

9. The method of claim 8 further comprising the step of mounting tabs to the strap to hold the strap within the ring.

* * * * *